United States Patent [19]

Franck

[11] 4,114,262

[45] Sep. 19, 1978

[54] CABLE CONNECTOR

[75] Inventor: Bent Franck, Bagsvaerd, Denmark

[73] Assignee: Dansk Signal Industri A/S, Hvidovre, Denmark

[21] Appl. No.: 742,928

[22] Filed: Nov. 18, 1976

Related U.S. Application Data

[63] Continuation of Ser. No. 603,985, Aug. 12, 1975, abandoned.

[30] Foreign Application Priority Data

Aug. 14, 1974 [DK] Denmark ..... 4328/74

[51] Int. Cl.[2] ..... H01H 69/00

[52] U.S. Cl. ..... 29/628; 339/276 RB

[58] Field of Search ..... 339/275 RB, 276; 29/628

[56] References Cited

U.S. PATENT DOCUMENTS

| | | | |
|---|---|---|---|
| 2,155,217 | 4/1939 | Bovard | 339/275 RB |
| 2,405,111 | 8/1946 | Carlson et al. | 339/276 T |
| 2,725,615 | 12/1955 | Edwards | 339/276 RB |
| 2,741,752 | 4/1956 | Edwards | 339/276 RB |
| 3,500,296 | 3/1970 | O'Keefe et al. | 339/276 T |

FOREIGN PATENT DOCUMENTS

| | | | |
|---|---|---|---|
| 533,031 | 11/1956 | Canada | 339/276 R |
| 285,593 | 1/1953 | Switzerland | 339/276 R |
| 1,313,655 | 4/1973 | United Kingdom | 339/276 R |

*Primary Examiner*—Joseph H. McGlynn
*Attorney, Agent, or Firm*—Nolte and Nolte

[57] ABSTRACT

A method of connecting an electrical cable connector to another electrically conductive object in which other object a hole is provided for receiving part of a connector element which connector element provides a first pin dimensioned for being driven into the hole, a head having a first bore extending radially relative to a second bore which extends coaxially with the axis of the first pin and intersecting the first bore and dimensioned for receiving a second pin dimensioned for being driven into the second bore and tightly engaging a cable received in the first bore, said method comprising inserting the cable in the first bore placing the first pin within the hole of the object and placing the second pin within the second bore and applying force upon the second pin to drive the same into the second bore to engage the cable and at the same time to drive the first pin into the hole.

1 Claim, 11 Drawing Figures

Figure 9:
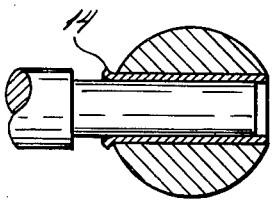

FIG. 1
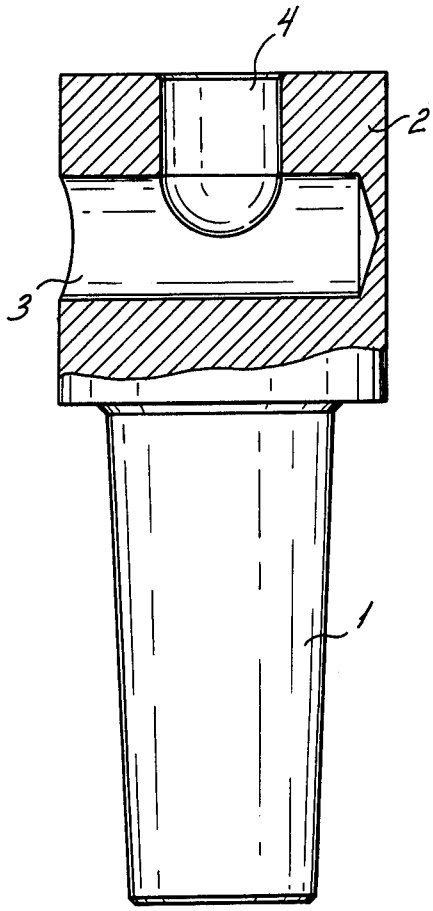
FIG. 2
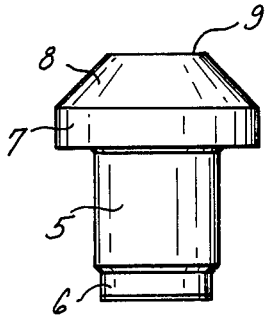
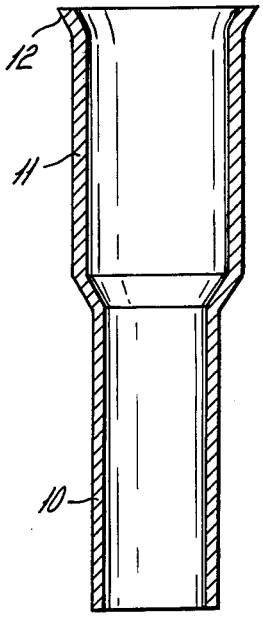
FIG. 3

FIG. 4
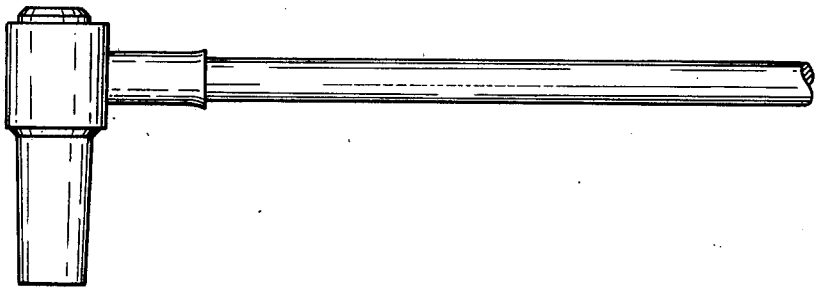
FIG. 5
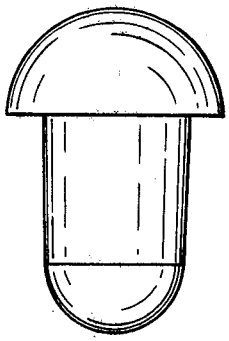
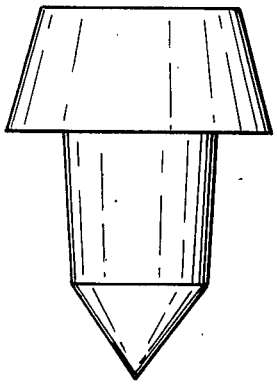
FIG. 6
FIG. 7
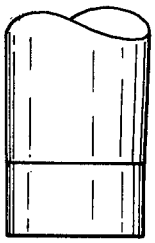
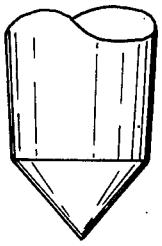
FIG. 8

CABLE CONNECTOR

This is a continuation of application Ser. No. 603,985 filed Aug. 12, 1975 now abandoned.

The invention relates to a cable connector for connect to an electric conducting object, mainly a rail bond, having a pin-shaped conical part, determined for being driven into a hole in the rail and a head with a sideways directed opening for connection of a cable.

It is an object of the invention to provide a cable connector, which can be manufactured comparatively inexpensive, which can be mounted easily and safely and which provides a safe electric connection. The characteristic of the cable connector according to the invention is that it has a two-part head, of which the one part has the sideways directed opening and in connection therewith an axial bore, while the other part has a pin part fitting the bore. The cable is led through the sideways directed opening on to or past the axial bore, the pin part is led into the axial bore, and the two parts of the head are driven towards each other, so that the pin part is driven through the axial bore against the side of the cable, by which it will lock same and bring about an effective electric connection. When the question is of a rail bond, the driving on of the pin part can advantageously take place in connection with the driving on of the pin-shaped conical part into a hole in the rail. The cable connector may, however, also be used for other purposes, such as e.g. the connection of a cable to a steel beam or another structural part, and it may be arranged for attachment in another manner, e.g. by screw fastening.

According to the invention the head of the cable connector may have a reduced impact surface. Hereby a central impact action is achieved.

According to the invention the pin part can have an end surface with an entirely or partly tapered shape or another shape with a decreasing cross section, such as e.g. hemispherical or conical shape for driving into the cable. Hereby a particularly effective electric connection between the pin part and the cable is achieved. Furthermore it can hereby be achieved, that it will be unnecessary to strip off the end of the cable, as the end surface of the pin part can penetrate the insulation.

According to the invention the pin part can be integral with the pin-shaped conical part, whereas the axial bore is arranged in a main part having on its end an impact surface. Hereby particularly the advantage is achieved, that the cable is comparatively easy to replace.

According to the invention the cable connector may be provided with a metal tube extending inwards through the side opening for protection of a stripped end part of the cable. Hereby damage to the stripped end part is avoided, which mainly consists of many single wires, which are twisted together.

The metal tube may according to the invention possess a part projecting from the head with an enlarged inside diameter for reception of a cable with insulation. Hereby the cable is protected against damages at the transition between the insulated part and the stripped part. Besides protection against penetration of water into the cable can be achieved.

Figure 10:
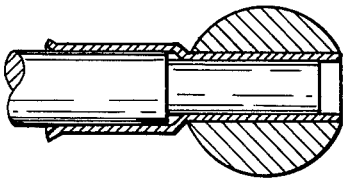
Figure 11:
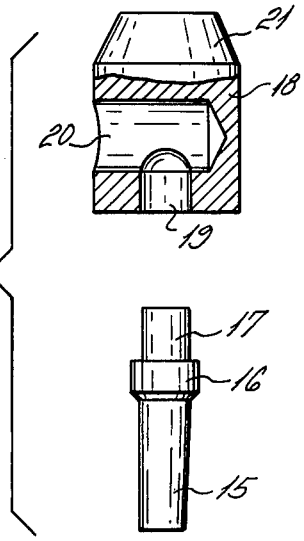

In the drawing are shown some embodiments of a cable connector according to the invention, as FIG. 1 shows a part including a pin-shaped conical part and a thickening with a transverse bore and a axial bore, partly in section, FIG. 2 a part having a pin part fitting the axial bore and a head with an impact surface, FIG. 3 a copper-tube part for introduction of the end of a cable, in section, FIG. 4 the rail bond shown in FIGS. 1–3 with a mounted cable, as viewed in side elevation, FIG. 5 a variant of the part shown in FIG. 2, as viewed in side elevation, FIG. 6 another variant of the part shown in FIG. 2, as viewed in side elevation, FIG. 7 the one end of a third variant, as viewed from one side, FIG. 8 the same as viewed at right angles thereto, FIG. 9 a variant of the head of the part shown in FIG. 1 with an inserted copper tube with a bell-mouthed enlargement at one end and an inserted stripped cable in top view section, FIG. 10 another variant of the part shown in FIG. 1 with an inserted copper tube of the embodiment shown in FIG. 3, and FIG. 11 a rail bond of another embodiment.

The rail bond shown in FIGS. 1–4 includes one part as shown in FIG. 1, one part as shown in FIG. 2 and one part as shown in FIG. 3. The part shown in FIG. 1 consists of steel and has a pinshaped conical part 1 preferably with a cone of 1 to 25, and a cylindrical head 2, in which is designed a sack hole 3, to which there is connected an axial hole 4 going out from the top end of the head. The part shown in FIG. 2 likewise consists of steel and has a pin part 5 with a narrowing end part 6 and a head with a cylindrical part 7 and a conical part 8 with a flat end surface 9. The part shown in FIG. 3 consists of a copper tube, which is designed with a cylindrical part 10, fitting in the hole 3, and an enlarged part 11, which has at its end a bell-mouthed-shaped part 12.

When mounting the rail bond shown in FIGS. 1–3 one must proceed in the following manner. A transverse hole is bored in the web of the rail. The length of the wire is adjusted and cut. The strands of the cable are twisted up by twisting them a couple of times to each side. Then they are twisted lightly, e.g. in the clockwise direction of movement. The wire is pressed easily into the head 2 by turning the wire from side to side. The rail bond is placed in the hole in the web of the rail. The rail bond is struck into the hole in the web of the rail, by which the part shown in FIG. 2 is struck into the hole 4, so that the end part 6 engages effectively with the cable. The connection is ready, when a light blow on the end surface 9 and the rail gives the same sound. It is advantageously to use a 2 kg hammer for the driving on. A simple and easy mounting and demounting without the use of special tools is achieved. The rail bond can be used several times. It has small dimensions and is not easily damaged by other activities on or at the rail. Small transition resistance is achieved.

In FIG. 5 is shown a variant of the part shown in FIG. 2. The part has a hemispherical head 12, by which is secured a central performance of the impact force of the hammer. Furthermore it has at the opposite end an entirely or mainly hemispherical end surface, by which is achieved a particularly effective penetration into the cable.

In FIG. 6 is shown another variant of the part shown in FIG. 2. The part has a truncated cone shaped head 13, by which is secured a central performance of the impact force. Furthermore it has at its opposite end a conical end surface, by which is achieved a particularly effective penetration into the cable. The end surface may be truncated cone-shaped with a suitably small end surface of the truncated cone.

FIGS. 7 and 8 show a third variant of the part shown in FIG. 2. The end surface in question of the pin 5 is tapered, so that it is well fit for penetrating into the cable.

The embodiments shown in FIGS. 5–8 are particularly well fit for use in connection with a non-stripped cable, as the end of the parts 5 in question is fit for penetrating the insulation layer. The same is the case with the embodiment shown in FIG. 2, when the part 6 has a suitably small diameter.

In the variant shown in FIG. 9 the bore 3 has been carried quite through the main part 2, and in the bore has been inserted a copper tube which has a funnel-shaped enlargement 14 to facilitate insertion of the cable, which is here shown with a stripped end part. In the variant shown in FIG. 10 the bore 3 has likewise been carried quite through the main part 2, and in the bore has been inserted a copper tube as the one shown in FIG. 3, and into this copper tube has been inserted the end of a cable, the stripped end part of which has been inserted in the part 10, while a non-stripped end part has been inserted in the part 11.

The rail bond shown in FIG. 11 likewise consists of two parts. The one part includes a conical pin shaped part 15 which is connected to a main part 16, which has a pin part 17 on the opposite side. The other part of the rail bond is designed as an impact head 18, which is designed with an axial bore 19 fitting the pin part 17 and a transverse sack hole 20, into which a cable end is introduced, mainly with a copper tube as described in connection with the embodiments shown in FIG. 1-10. The part 18 has a truncated cone shaped part 21, the end surface of which serves as an impact surface. The pin part 17 is carried into the axial bore 19. At the driving on of the rail bond into the hole in the rail the pin part 17 will be driven against the side of the cable end in the hole 20, so that a safe attachment of the cable and a good and safe electric connection will be achieved. The embodiment shown in FIG. 11 has the advantage of easy replacement of the cable.

The details of the various embodiments and variants may be combined in different manners. The pin parts 5, 17 with variants can be cylindrical with an excess in relation to the bore 4, 19 or conical likewise with an excess, so that a safe attachment at the driving on is achieved.

What I claim is:

1. A method of connecting an electrical cable connector to another electrically conductive object in which other object a hole is provided for receiving part of a connector element which connector element provides a first pin dimensioned for being driven into the hole, a head having a first bore extending radially relative to a second bore which extends coaxilly with the axis of the first pin and intersecting the first bore and dimensioned for receiving a second pin dimensioned for being driven into the second bore and tightly engaging a cable received in the first bore, said method comprising inserting the cable in the first bore placing the first pin within the hole of the object and placing the second pin within the second bore and applying force upon the second pin to drive the same into the second bore to engage the cable and at the same time to drive the first pin into the hole.

* * * * *